US009683442B2

(12) United States Patent
Dextraze et al.

(10) Patent No.: US 9,683,442 B2
(45) Date of Patent: Jun. 20, 2017

(54) TURBOCHARGER SHROUD WITH CROSS-WISE GROOVES AND TURBOCHARGER INCORPORATING THE SAME

(71) Applicant: BorgWarner Inc., Auburn Hills, MI (US)

(72) Inventors: Stephanie Dextraze, Bristol, CT (US); David G. Grabowska, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 228 days.

(21) Appl. No.: 14/395,281

(22) PCT Filed: Apr. 11, 2013

(86) PCT No.: PCT/US2013/036089

§ 371 (c)(1),
(2) Date: Oct. 17, 2014

(87) PCT Pub. No.: WO2013/162896

PCT Pub. Date: Oct. 31, 2013

(65) Prior Publication Data

US 2015/0118079 A1 Apr. 30, 2015

Related U.S. Application Data

(60) Provisional application No. 61/637,146, filed on Apr. 23, 2012.

(51) Int. Cl.
*F04D 25/04* (2006.01)
*F01D 5/14* (2006.01)
(Continued)

(52) U.S. Cl.
CPC ..... *F01D 5/143* (2013.01); *F01D 5/048* (2013.01); *F01D 5/145* (2013.01); *F01D 5/146* (2013.01);
(Continued)

(58) Field of Classification Search
CPC .... F04D 29/685; F04D 29/526; F04D 29/545; F04D 29/547; F04D 29/4213; Y10S 415/914
(Continued)

(56) References Cited

U.S. PATENT DOCUMENTS 4,212,585 A * 7/1980 Swarden ..... F04D 27/0215 415/198.1
4,466,772 A * 8/1984 Okapuu ..... F01D 11/08 415/171.1
(Continued)

FOREIGN PATENT DOCUMENTS

CN 1821552 A 8/2006
CN 101749283 A 6/2010
(Continued)

OTHER PUBLICATIONS

International Application No. PCT/US2013/035745, International Search Report & Written Opinion, 12 pages, Jul. 9, 2013.
(Continued)

*Primary Examiner* — Peter J Bertheaud
(74) *Attorney, Agent, or Firm* — Perkins Coie LLP

(57) ABSTRACT

A turbocharger (5) comprising a housing (10) including a compressor shroud (14) and a turbine shroud (12). A compressor wheel (18) is disposed in the compressor shroud (14) and includes a plurality of compressor blades (45, 46). Each compressor blade (45, 46) includes a leading edge (50, 51) and a compressor shroud contour edge (54, 55), wherein each compressor shroud contour edge (54, 55) is in close
(Continued)

confronting relation to the compressor shroud (14). A turbine wheel (16) is disposed in the turbine shroud (12) and includes a plurality of turbine blades (26). Each turbine blade (26) includes a leading edge (30) and a turbine shroud contour edge (34), wherein each turbine shroud contour edge (34) is in close confronting relation to the turbine shroud (12). At least one of the compressor shroud (14) and turbine shroud (12) includes a plurality of grooves (70, 72) extending cross-wise with respect to the corresponding compressor or turbine shroud contour edges (34, 54, 55).

3 Claims, 11 Drawing Sheets

(51) Int. Cl.

| | |
|---|---|
| ***F01D 5/20*** | (2006.01) |
| ***F01D 11/02*** | (2006.01) |
| ***F04D 29/16*** | (2006.01) |
| ***F04D 29/42*** | (2006.01) |
| ***F04D 29/68*** | (2006.01) |
| ***F01D 5/04*** | (2006.01) |
| ***F04D 17/10*** | (2006.01) |
| ***F04D 29/28*** | (2006.01) |
| *F04D 29/52* | (2006.01) |

(52) U.S. Cl.
CPC ..... *F01D 5/20* (2013.01); *F01D 11/02* (2013.01); *F04D 17/10* (2013.01); *F04D 25/04* (2013.01); *F04D 29/162* (2013.01); *F04D 29/284* (2013.01); *F04D 29/4206* (2013.01); *F04D 29/685* (2013.01); *F04D 29/526* (2013.01); *F05D 2220/40* (2013.01); *Y10S 415/914* (2013.01)

(58) Field of Classification Search
USPC ..... 417/405–407
See application file for complete search history.

(56) References Cited

U.S. PATENT DOCUMENTS

| | | | | |
|---|---|---|---|---|
| 4,781,530 | A * | 11/1988 | Lauterbach | F04D 27/0215 415/173.1 |
| 5,277,541 | A * | 1/1994 | Palmer | F04D 29/4213 415/206 |
| 5,466,118 | A * | 11/1995 | Heinrich | F04D 29/4213 415/208.3 |
| 5,476,363 | A | 12/1995 | Freling et al. | |
| 6,086,328 | A | 7/2000 | Lee | |
| 6,164,911 | A | 12/2000 | LeBlanc | |
| 6,190,129 | B1 | 2/2001 | Mayer et al. | |
| 6,478,537 | B2 | 11/2002 | Junkin | |
| 6,761,539 | B2 | 7/2004 | Cipelletti et al. | |
| 6,830,428 | B2 | 12/2004 | Le Biez et al. | |
| 7,189,059 | B2 | 3/2007 | Barton et al. | |
| 7,338,251 | B2 * | 3/2008 | Ro | F04D 29/162 415/173.1 |
| 7,946,825 | B2 | 5/2011 | Tudor | |
| 8,157,504 | B2 | 4/2012 | Amaral et al. | |
| 2004/0213661 | A1 | 10/2004 | Sekularac | |
| 2005/0152786 | A1 | 7/2005 | Ro et al. | |
| 2009/0155058 | A1 | 6/2009 | Noelle | |
| 2010/0143095 | A1 | 6/2010 | Higashimori et al. | |
| 2010/0232979 | A1 | 9/2010 | Paauwe et al. | |
| 2011/0091323 | A1 | 4/2011 | Koike et al. | |
| 2011/0252792 | A1 | 10/2011 | Kares et al. | |
| 2012/0269638 | A1 | 10/2012 | Dyer et al. | |

FOREIGN PATENT DOCUMENTS

| | | | |
|---|---|---|---|
| CN | 201650444 | U | 11/2010 |
| CN | 102220883 | A | 10/2011 |
| JP | 9-133095 | A | 5/1997 |
| JP | 2002-21574 | A | 1/2002 |
| JP | 2002-47944 | A | 2/2002 |
| JP | 2008-223532 | A | 9/2008 |
| JP | 2009-108791 | A | 5/2009 |
| JP | 2012-47085 | A | 3/2012 |

OTHER PUBLICATIONS

International Application No. PCT/US2013/036089, International Search Report & Written Opinion, 11 pages, Jul. 22, 2013.
International Application No. PCT/US2013/036093, International Search Report & Written Opinion, 11 pages, Jul. 26, 2013.
Chinese Patent Application No. 201380017649.8, Office Action, 24 pages, Mar. 3, 2016.
Chinese Patent Application No. 201380017671.2, Office Action, 23 pages, Feb. 3, 2016.
Chinese Patent Application No. 201380018193.7, Office Action, 10 pages, Mar. 16, 2016.

* cited by examiner

TURBOCHARGER SHROUD WITH CROSS-WISE GROOVES AND TURBOCHARGER INCORPORATING THE SAME

BACKGROUND

Today's internal combustion engines must meet ever-stricter emissions and efficiency standards demanded by consumers and government regulatory agencies. Accordingly, automotive manufacturers and suppliers expend great effort and capital in researching and developing technology to improve the operation of the internal combustion engine. Turbochargers are one area of engine development that is of particular interest.

A turbocharger uses exhaust gas energy, which would normally be wasted, to drive a turbine. The turbine is mounted to a shaft that in turn drives a compressor. The turbine converts the heat and kinetic energy of the exhaust into rotational power that drives the compressor. The objective of a turbocharger is to improve the engine's volumetric efficiency by increasing the density of the air entering the engine. The compressor draws in ambient air and compresses it into the intake manifold and ultimately the cylinders. Thus, a greater mass of air enters the cylinders on each intake stroke.

The more efficiently the turbine can convert the exhaust heat energy into rotational power and the more efficiently the compressor can push air into the engine, the more efficient the overall performance of the engine. Accordingly, it is desirable to design the turbine and compressor wheels to be as efficient as possible. However, various losses are inherent in traditional turbine and compressor designs due to turbulence and leakage.

While traditional turbocharger compressor and turbine designs have been developed with the goal of maximizing efficiency, there is still a need for further advances in compressor and turbine efficiency.

SUMMARY

Provided herein is a turbocharger comprising a housing including a compressor shroud. A compressor wheel is disposed in the compressor shroud and includes a plurality of compressor blades. Each compressor blade includes a leading edge and a shroud contour edge, wherein each shroud contour edge is in close confronting relation to the compressor shroud. The compressor shroud includes a plurality of grooves extending cross-wise with respect to the shroud contour edges of the compressor blades.

In certain aspects of the technology described herein, the grooves are equally spaced. The compressor shroud includes an inlet region and discharge region, and the grooves extend from the inlet region to the discharge region. In an embodiment, the grooves extend arcuately from the inlet region to the discharge region. The grooves may have a rectangular cross-section, for example.

Also provided herein is a turbocharger comprising a housing including a turbine shroud. A turbine wheel is disposed in the turbine shroud and includes a plurality of turbine blades. Each turbine blade includes a leading edge and a shroud contour edge, wherein each shroud contour edge is in close confronting relation to the turbine shroud. The turbine shroud includes a plurality of grooves extending cross-wise with respect to the shroud contour edges of the turbine blades.

Also contemplated is a turbocharger comprising a housing including a compressor shroud and a turbine shroud. A compressor wheel is disposed in the compressor shroud and includes a plurality of compressor blades. Each compressor blade includes a leading edge and a compressor shroud contour edge, wherein each compressor shroud contour edge is in close confronting relation to the compressor shroud. A turbine wheel is disposed in the turbine shroud and includes a plurality of turbine blades. Each turbine blade includes a leading edge and a turbine shroud contour edge, wherein each turbine shroud contour edge is in close confronting relation to the turbine shroud. At least one of the compressor shroud and turbine shroud includes a plurality of grooves extending cross-wise with respect to the corresponding compressor or turbine shroud contour edges.

These and other aspects of the turbocharger shroud with cross-wise grooves and turbocharger incorporating the same will be apparent after consideration of the Detailed Description and Figures herein. It is to be understood, however, that the scope of the invention shall be determined by the claims as issued and not by whether given subject matter addresses any or all issues noted in the background or includes any features or aspects recited in this summary.

DRAWINGS

Non-limiting and non-exhaustive embodiments of the turbocharger shroud with cross-wise grooves and turbocharger incorporating the same, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
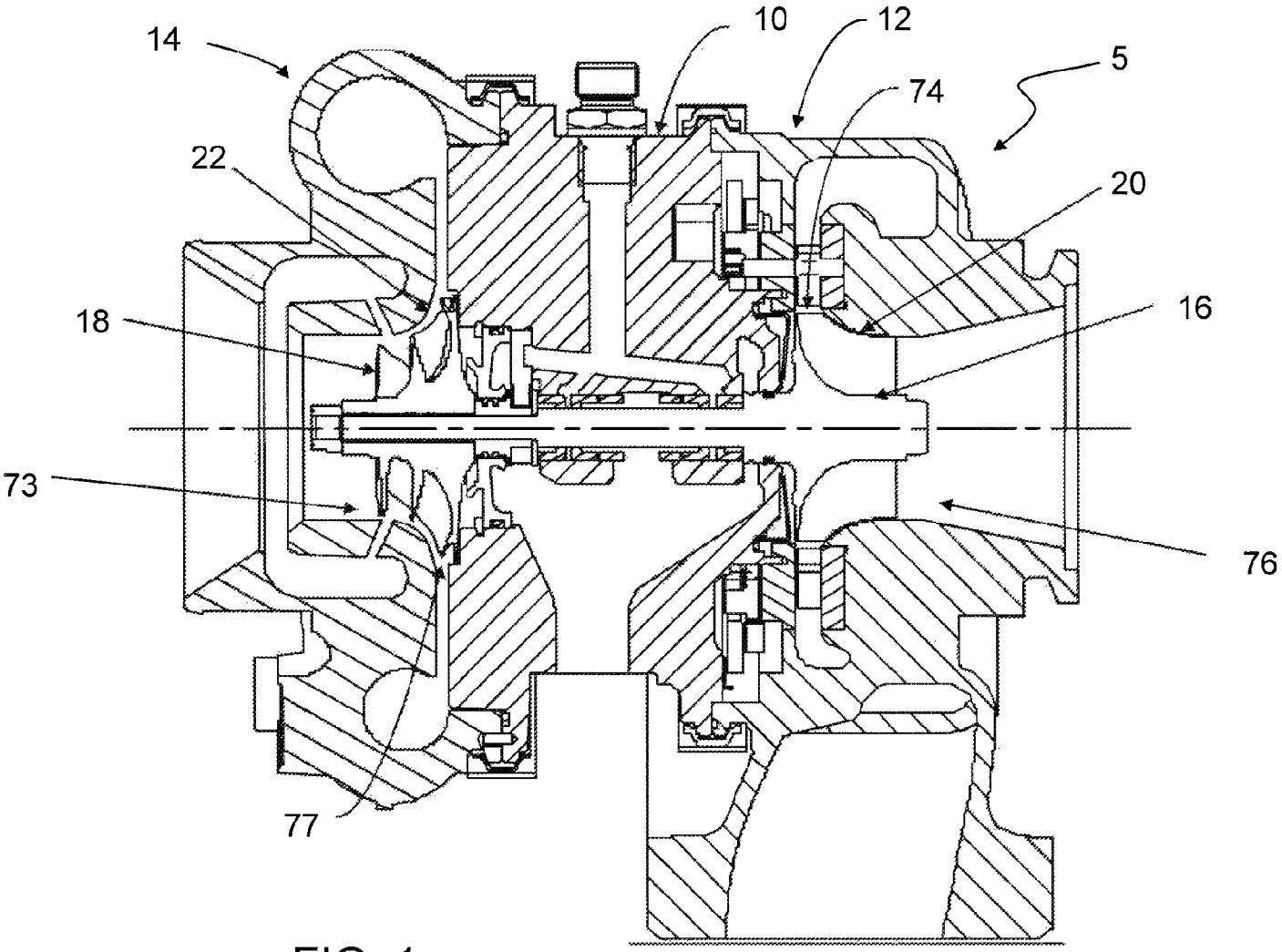
FIG. 1 is a side view in a cross-section of a turbocharger according to an exemplary embodiment.

As shown in FIG. 1, turbocharger 5 includes a bearing housing 10 with a turbine shroud 12 and a compressor shroud 14 attached thereto. Turbine wheel 16 rotates within the turbine shroud 12 in close proximity to the turbine shroud inner surface 20. Similarly, the compressor wheel 18 rotates within the compressor shroud 14 in close proximity to the compressor shroud inner surface 22. The construction of turbocharger 5 is that of a typical turbocharger as is well known in the art. However, turbocharger 5 includes various improvements to efficiency which are explained more fully herein.

Figure 3:
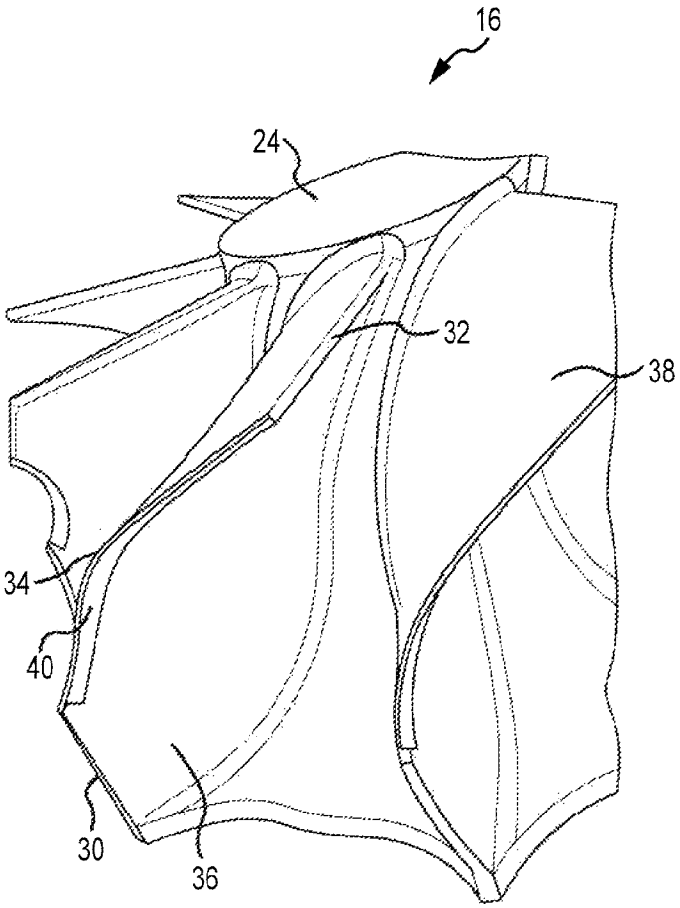
FIG. 3 is an enlarged partial perspective view of the turbine wheel shown in FIG. 2.
Figure 2:
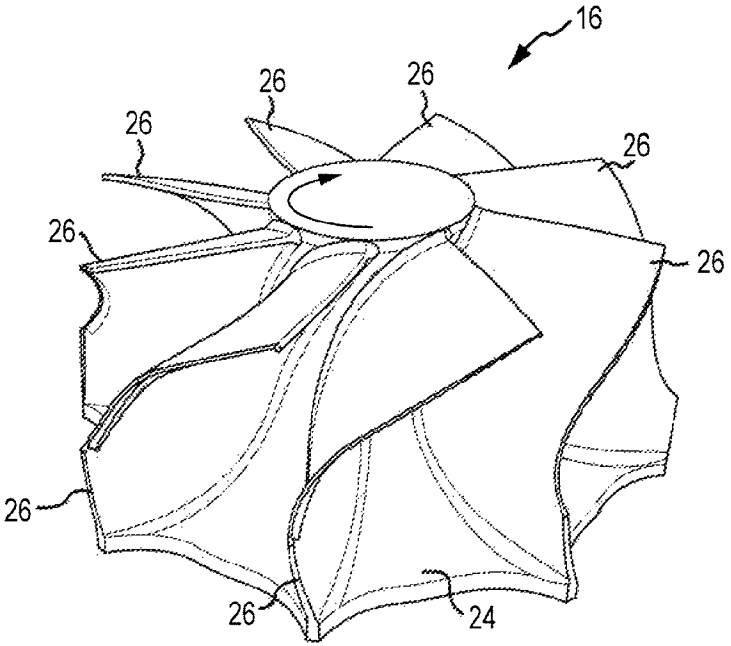
FIG. 2 is a perspective view of a turbine wheel according to a first exemplary embodiment.

As shown in FIG. 2, turbine wheel 16 includes a hub 24 from which a plurality of blades 26 extend. Each blade 26 includes a leading edge 30 and a trailing edge 32 between which extends a shroud contour edge 34. The shroud contour edge is sometime referred to herein as the tip of the blade. In traditional turbine wheel configurations, a significant loss of turbine efficiency is due to leakages across the tip of the turbine blades. The physics of the flow between the turbine blades results in one surface of the blade (the pressure side 36) being exposed to a high pressure, while the other side (the suction side 38) is exposed to a low pressure (see FIG. 3). This difference in pressure results in a force on the blade that causes the turbine wheel to rotate. With reference again to FIG. 1, it can be seen that shroud contour edge 34 is in close proximity to turbine shroud inner surface 20, thereby forming a gap between them. These high and low pressure regions cause secondary flow to travel from the pressure side 36 of the turbine blade to the suction side 38 through the gap between the turbine blade tip 34 and the inner surface 20 of the turbine shroud. This secondary flow is a loss to the overall system and is a debit to turbine efficiency. Ideally, there would not be a gap between the tip and shroud, but a gap is necessary to prevent the tip from rubbing on the shroud and to account for thermal expansion and centrifugal loading on the turbine blades which causes the blades to grow radially.

In this embodiment, however, turbine blades 26 include an edge relief 40 formed along the tip or shroud contour edge 34. In this case, when flow travels through the gap, the edge relief 40 creates a high pressure region in the edge relief (relative to the pressure side 36) which causes the flow to stagnate. In addition, the high pressure region causes the flow across the gap to become choked, thereby limiting the flow rate. Therefore, the secondary flow is reduced which increases the efficiency of the turbine. As can be appreciated from FIG. 3, in this case the edge relief 40 extends along a majority of the shroud contour edge 34 without extending past the ends of the edge of the blade. This creates a pocket or a scoop that further acts to create relative pressure in the edge relief.

Figure 6:
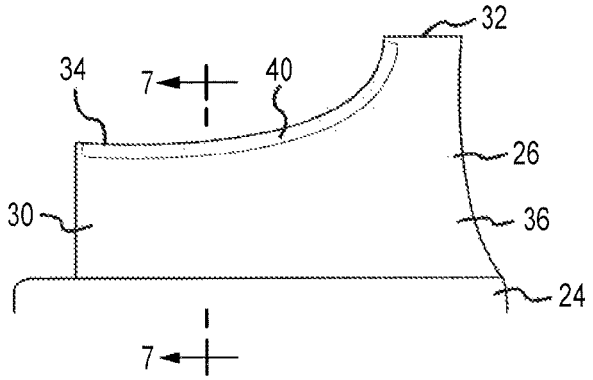
FIG. 6 is a side view diagram representing one of the turbine blades shown in FIG. 3.
Figure 7A:
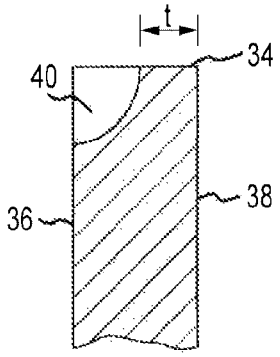
FIGS. 7A-7D are partial cross-sections of the turbine blade taken about line 7-7 in FIG. 6 showing different edge relief configurations.
Figures 7B, 7C, 7D:
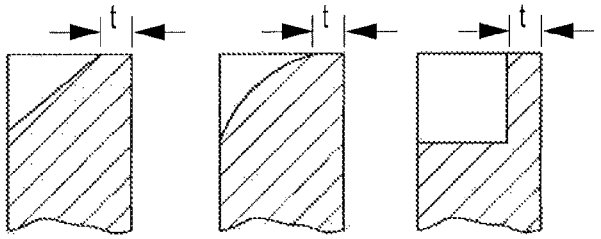

With further reference to FIG. 6, edge relief 40 is shown schematically along shroud contour edge 34. The cross-section of blade 26 shown in FIG. 7A illustrates the profile configuration of the edge relief 40. In this case, the edge relief is shown as a cove having an inner radius. Although shown here in the form of a cove, the edge relief could be formed as a chamfer, a radius, or a rabbet as shown in FIGS. 7B-7D, respectively. As indicated in FIGS. 7A-7D, edge relief 40 is formed into the pressure side 36 of blade 26. The remaining edge material of the shroud contour edge is represented as thickness t in FIGS. 7A-7D. It has been found that minimizing the thickness t of the remaining tip causes the flow to choke more quickly. The thickness t may be expressed as a percentage of the blade thickness. For example, thickness t should be less than 75% of the blade thickness and preferably less than 50% of the blade thickness. However, the minimum thickness is ultimately determined by the technology used to create the edge relief. The relief may be machined or cast into the edge of the blade. Accordingly, the edge relief is a cost effective solution to improve efficiency of the turbine and compressor wheels.

Figure 4:
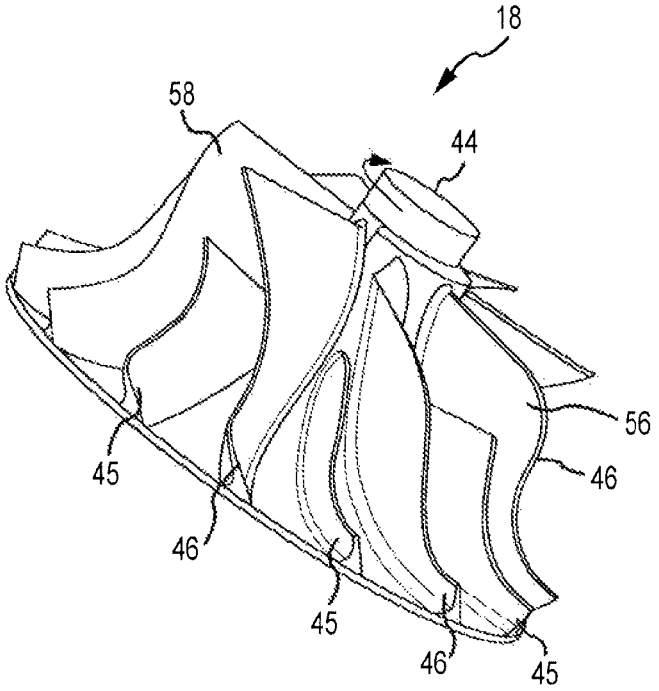
FIG. 4 is a perspective view of a compressor wheel according to a first exemplary embodiment.
Figure 5:
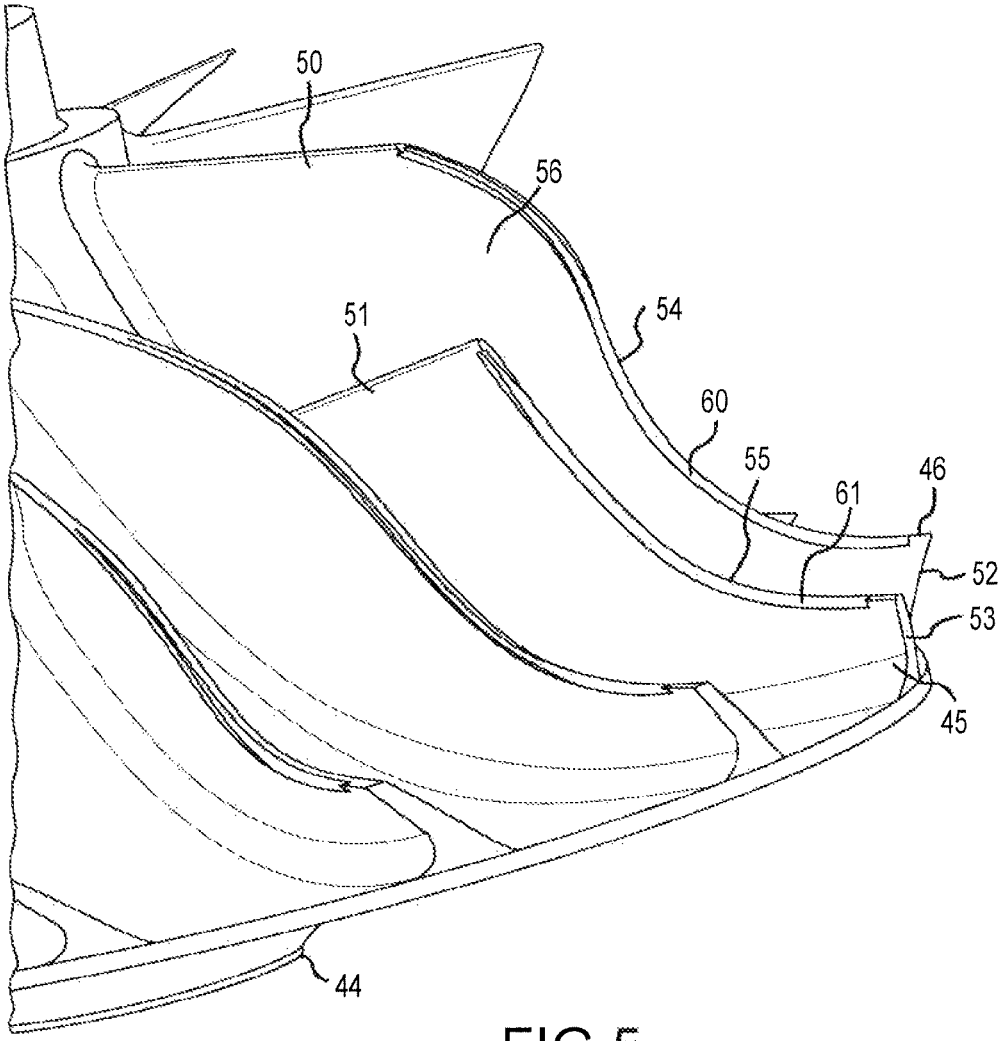
FIG. 5 is an enlarged partial perspective view of the compressor wheel shown in FIG. 4.

With reference to FIGS. 4 and 5, it can be appreciated that the blades 45 and 46 of compressor wheel 18 may also be formed with edge reliefs 61 and 60, respectively. In this case, compressor wheel 18 includes a hub 44 from which radially extend a plurality of blades 46 with a plurality of smaller blades 45 interposed therebetween. With reference to FIG. 5, each blade 46 includes a leading edge 50, a trailing edge 52, and a compressor shroud contour edge 54 extending therebetween. In similar fashion, the smaller blades 45 include a leading edge 51, a trailing edge 53, and a shroud contour edge 55 extending therebetween. Edge reliefs 61 and 60 extend along a majority of their respective shroud contour edges. As with the turbine wheel blades, the edge reliefs are formed along the pressure side of the blade. Thus, in the case of the compressor blades, the edge reliefs 60 and 61 are formed on the pressure side 56, as shown in FIG. 5. Similar to the turbine blade edge reliefs, the compressor blade edge reliefs reduce flow from the pressure side 56 to the suction side 58, thereby increasing the efficiency of the compressor wheel.

Figure 8:
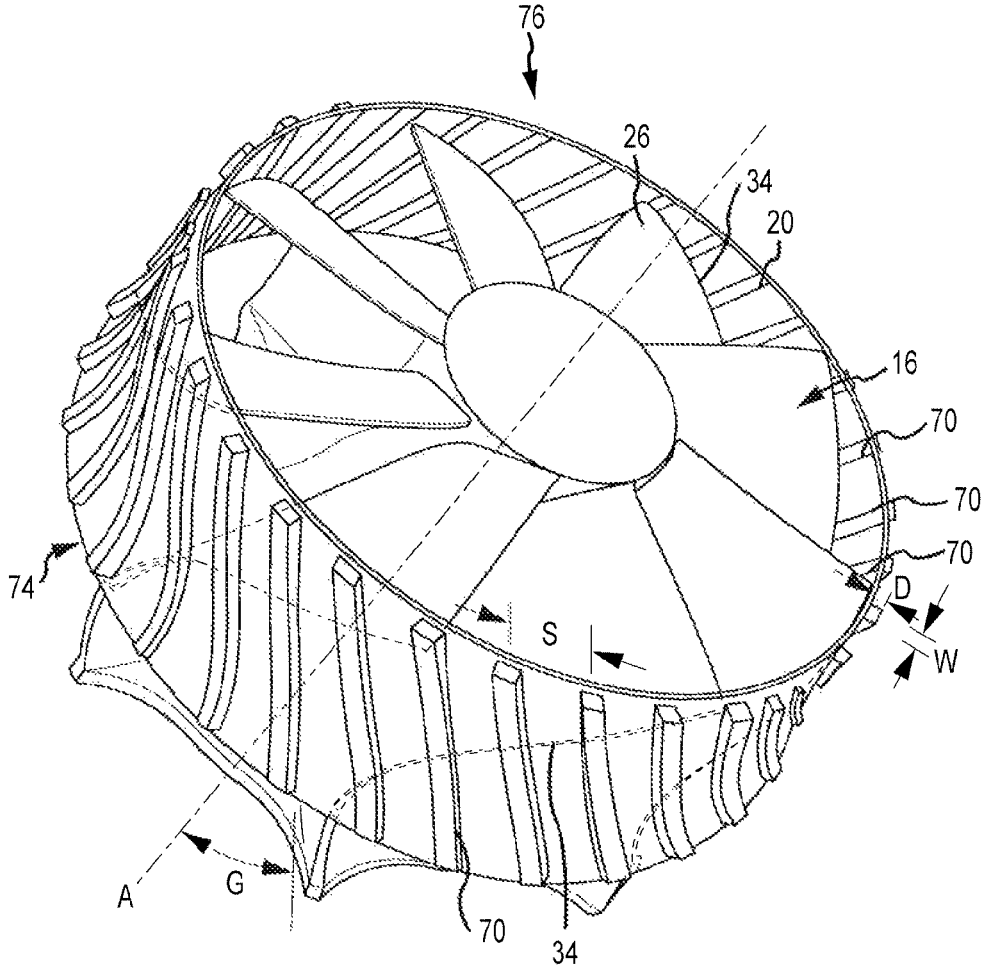
FIG. 8 is a perspective view representing the interface of a turbine wheel and the inner surface of a turbine shroud according to an exemplary embodiment.
Figure 9:
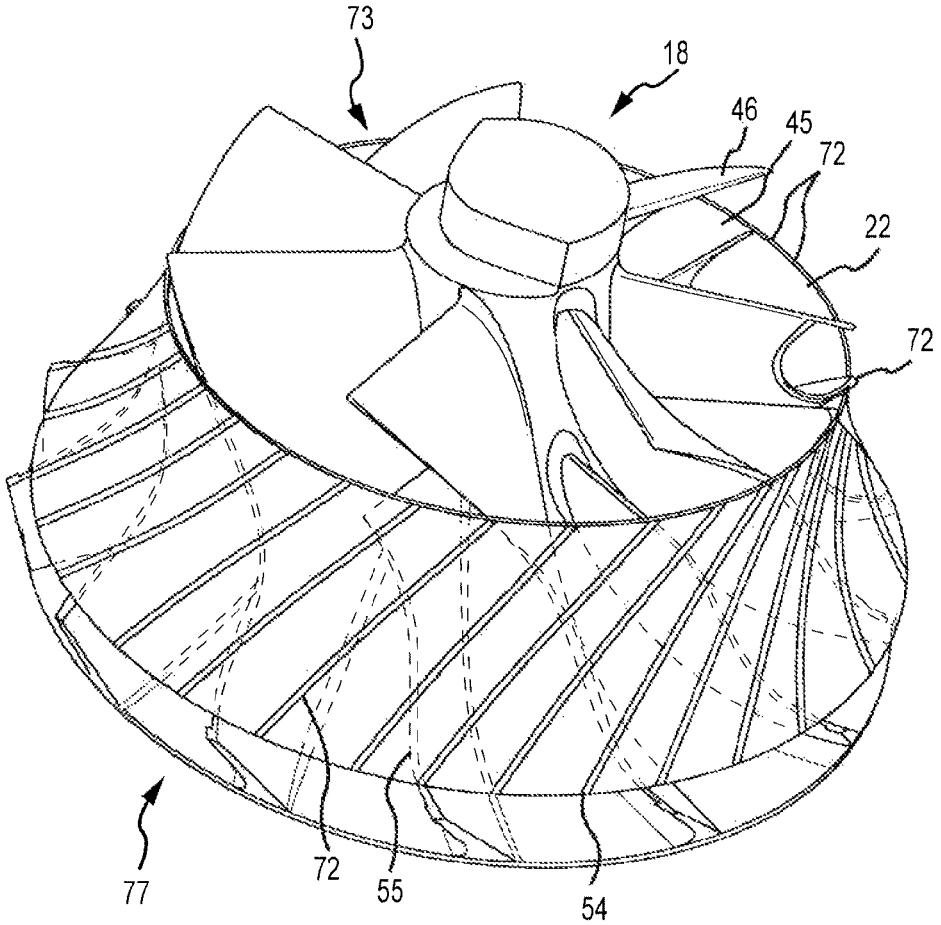
FIG. 9 is a perspective view representing the interface between a compressor wheel and the inner surface of a compressor shroud according to an exemplary embodiment.

Another way to disrupt the flow from the pressure side to the suction side of turbocharger turbine and compressor blades is shown in FIGS. 8 and 9. As shown in FIG. 8, the turbine shroud inner surface 20 includes a plurality of grooves 70 that extend crosswise with respect to the shroud contour edges 34 of the turbine blades 26. Therefore, the grooves extend at an angle G with respect to the axis A of turbine wheel 16. The angle G is related to the number of blades on the compressor or turbine wheel. In one embodiment, for example, the angle G is adjusted such that the grooves cross no more than two adjacent blades. In this case, the grooves are rectangular in cross-section and have a width w and a depth d. As an example, the width may range from approximately 0.5 to 2 mm and the depth may range from approximately 0.5 to 3 mm. The grooves extend arcuately from the inlet region 74 to the discharge region 76 of the shroud surface 20. As can be appreciated, the grooves are circumferentially spaced equally about the shroud surface at a distance S. However, in other embodiments, the spacing may vary from groove to groove. Distance S has a limitation similar to the angle G, in that the spacing is limited by the number of blades. As an example, S may be limited by having no more than 15 grooves crossing a single blade.

With reference to FIG. 9, the compressor shroud surface 22 also includes a plurality of grooves 72 formed in the inner surface 22 of the compressor shroud 14. Grooves 72 extend crosswise with respect to the shroud contour edges 54 and 55 of blades 46 and 45, respectively. In this case, the grooves extend arcuately from the inlet region 73 to the discharge region 77 of the shroud surface 22. While the grooves 70 and 72 are shown here to have rectangular cross-sections, other cross-sections may work as well, such as round or V-shaped cross-sections. As the shroud contour edge of each blade passes the crosswise-oriented grooves, the flow across the tip or shroud contour edge is disrupted (stagnated) by turbulence created in the grooves.

Figure 10:
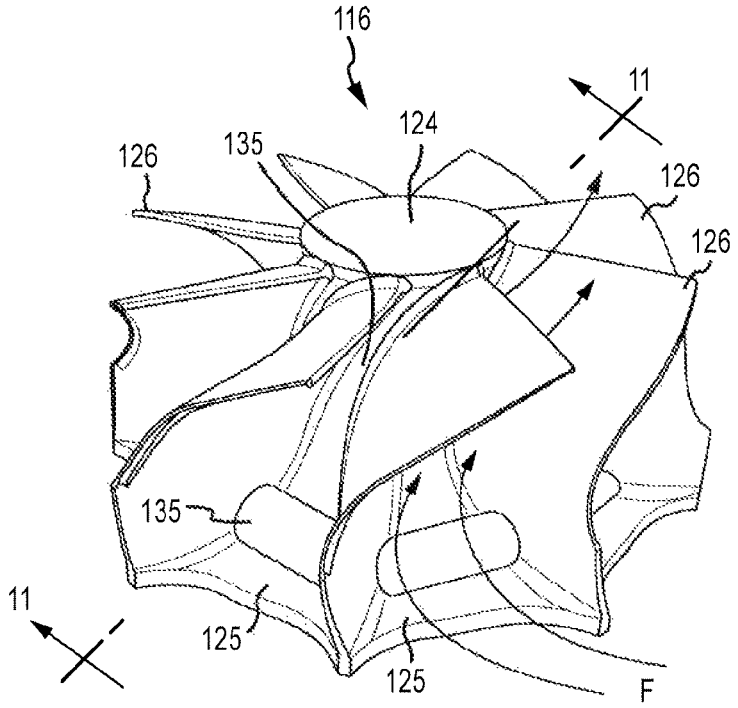
FIG. 10 is a perspective view illustrating a turbine wheel, according to a second exemplary embodiment, incorporating hub surface discontinuities.
Figure 11:
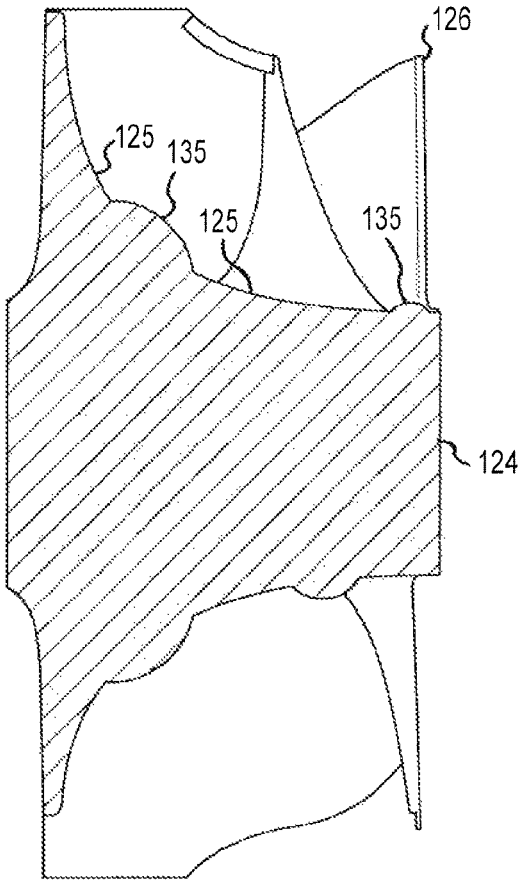
FIG. 11 is a side view in cross-section of the turbine wheel taken about lines 11-11 in FIG. 10.
Figure 12:
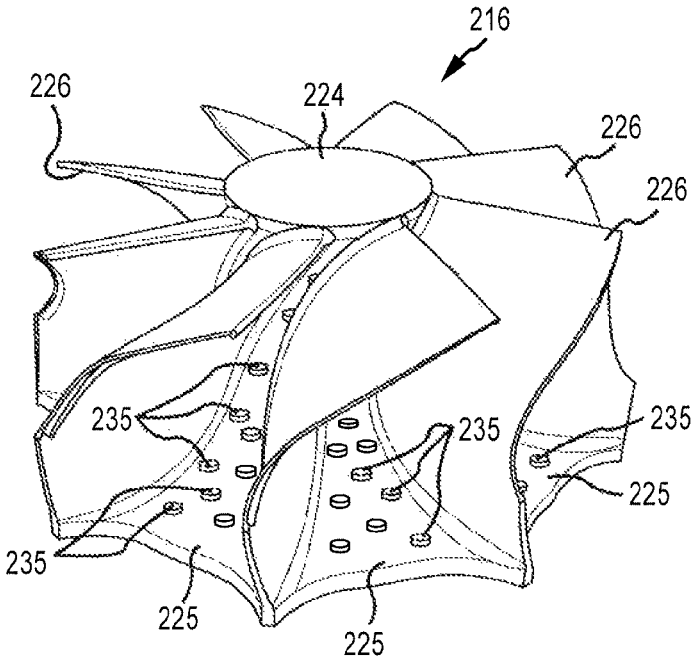
FIG. 12 is a perspective view of a turbine wheel, according to a third exemplary embodiment, illustrating an alternative surface discontinuity configuration.
Figure 14:
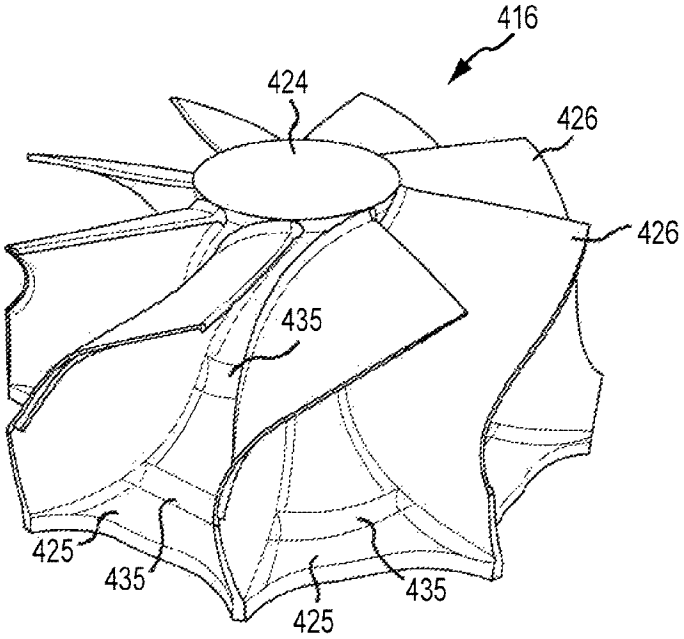
FIG. 14 is a perspective view of a turbine wheel, according to a fifth exemplary embodiment, illustrating yet another alternative surface discontinuity configuration.
Figure 13:
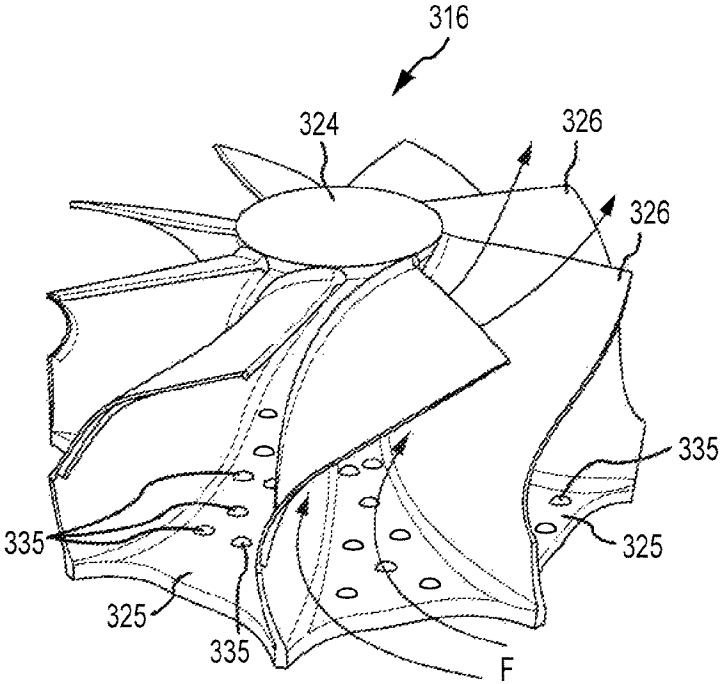
FIG. 13 is a perspective view of a turbine wheel, according to a fourth exemplary embodiment, illustrating another alternative surface discontinuity configuration.

As yet another way to increase the efficiency of the turbine and compressor wheels, the wheels may include a surface discontinuity around the hub. As shown in FIGS. 10-14, the turbine wheel may include a surface discontinuity formed around the hub of the turbine wheel to impart energy into the boundary layer of a fluid flow associated with the hub. For example, FIG. 10 illustrates an exemplary embodiment of a turbine wheel 116 having a hub 124 with a pair of circumferentially-extending ribs 135 that are operative to energize a boundary layer of a fluid flow F associated with hub 124. The blades 126 are circumferentially spaced around the turbine hub 124 with a hub surface 125 extending between adjacent blades. Each surface 125 includes at least one surface discontinuity, in this case, in the form of ribs 135. As shown in FIG. 11, the cross-section of the hub indicates a concave outer surface 125 extending between each blade with the surface discontinuity or ribs 135 protruding therefrom. In this case, the ribs act to accelerate the flow F over each rib, thereby energizing the boundary layer of fluid flow associated with the hub in order to disrupt the formation of vortices that impact turbine efficiency. FIG. 12 illustrates a turbine wheel 216 according to another exemplary embodiment. In this case, turbine wheel 216 includes a hub 224 with a plurality of blades 226 extending radially therefrom. A hub surface 225 extends between each adjacent turbine blade 226. In this case, the surface discontinuities are in the form of a plurality of protuberances 235. These protuberances could be in the form of bumps, disks, ribs, triangles, etc. As shown in FIGS. 13 and 14, the turbine wheels include surface discontinuities in the form of dimples or grooves. For example, FIG. 13 illustrates hub surface 325 extending between adjacent turbine blades 326 and includes a plurality of surface discontinuities in the form of dimples 335. Dimples 335 may be similar to those found on a golf ball. In FIG. 14, turbine wheel 416 includes a hub 424 with hub surfaces 425 extending between adjacent blades 426. In this case, the surface discontinuities are in the form of grooves 435 extending circumferentially around hub 424.

Accordingly, the turbocharger shrouds with cross-wise grooves have been described with some degree of particularity directed to the exemplary embodiments. It should be appreciated; however, that the present invention is defined by the following claims construed in light of the prior art so that modifications or changes may be made to the exemplary embodiments without departing from the inventive concepts contained herein.

What is claimed is:

1. A turbocharger (5), comprising:

a housing (10) including a compressor shroud (14) and a turbine shroud (12);

a compressor wheel (18) disposed in the compressor shroud (14) and including a plurality of compressor blades (45, 46), each compressor blade (45,46) including a leading edge (50, 51) and a compressor shroud contour edge (54, 55), wherein each compressor shroud contour edge (54, 55) is in close confronting relation to the compressor shroud (14);

a turbine wheel (16) disposed in the turbine shroud (12) and including a plurality of turbine blades (26), each turbine blade (26) including a leading edge (30) and a turbine shroud contour edge (34), wherein each turbine shroud contour edge (34) is in close confronting relation to the turbine shroud (12); and wherein at least one of the compressor shroud (14) and turbine shroud (12) includes a plurality of grooves (70, 72) extending cross-wise with respect to the corresponding compressor or turbine shroud contour edges (34, 54, 55).

2. The turbocharger (5) according to claim 1, wherein the plurality of grooves (70, 72) are equally spaced.

3. The turbocharger (5) according to claim 1, wherein the grooves (70, 72) have a rectangular cross-section.

* * * * *